United States Patent [19]

Rymaruk

[11] Patent Number: 4,936,293

[45] Date of Patent: Jun. 26, 1990

[54] MARTIAL ARTS CONDITIONING HAMMER

[76] Inventor: Ihor Rymaruk, 25 McClellan Dr., Amsterdam, N.Y. 12010

[21] Appl. No.: 357,996

[22] Filed: May 30, 1989

[51] Int. Cl.[5] ..... A61H 23/06

[52] U.S. Cl. ..... 128/54; 128/67

[58] Field of Search ..... 272/76; 128/54, 67

[56] References Cited

U.S. PATENT DOCUMENTS

| | | | |
|---|---|---|---|
| 193,449 | 7/1877 | Klemm | 128/54 |
| 233,758 | 10/1880 | Holbrook | 128/54 |
| 323,447 | 8/1885 | Ruebsam | 128/54 |
| 1,254,974 | 1/1918 | Briggs | 128/54 |
| 3,039,457 | 6/1962 | Boudkevitch et al. | 128/54 |
| 3,867,928 | 2/1975 | Tupper | 128/54 |
| 4,836,533 | 6/1989 | Dong | 272/76 |

FOREIGN PATENT DOCUMENTS

| | | | |
|---|---|---|---|
| 479745 | 7/1929 | Fed. Rep. of Germany | 128/54 |
| 1145001 | 10/1957 | France | 128/54 |
| 274306 | 7/1927 | United Kingdom | 128/54 |

*Primary Examiner*—Edgar S. Burr
*Assistant Examiner*—Tonya Lamb
*Attorney, Agent, or Firm*—Schmeiser, Morelle & Watts

[57] ABSTRACT

A conditioning hammer of unitary construction, one end of the hammer being formed in a handle and the other end having longitudinal bifurcating slits creating a plurality of rods. The depth of the slits between the rods as well as the widths of the slits are varied in order to obtain different degrees of rigidity for use when impacting ones body to condition and desensitize a predetermined area. The hammer is rectangular and therefore different sides of the rods are of varying widths in order to increase or lessen the impact area.

10 Claims, 2 Drawing Sheets

MARTIAL ARTS CONDITIONING HAMMER

FIELD OF THE INVENTION

Generally, this invention relates to body conditioning devices. More specifically, this invention is a martial arts conditioning hammer With multiple impact surfaces of varying resistance for hardening and desensitizing specific areas of the body.

BACKGROUND OF THE INVENTION

Effective martial arts training includes the teaching of both striking and blocking techniques. While these various techniques will vary depending upon the type of martial arts training involved, virtually all require a relatively significant amount of physical ability. For this reason, body conditioning is an important part of martial arts training. This conditioning includes the strengthening of ones muscles as well as exercises for agility, speed, and endurance. Such conditioning also may include the desensitizing of various parts of the body. Most well known is the desensitizing that is done to the side of the hand which is utilized in some forms of karate.

In Okinawan Karate, karate masters have for generations worked to desensitize various parts of their body to better enable them to block strikes without pain. Areas of the body commonly desensitized for such purposes include the forearms and lower legs. This conditioning is important since blocking a strike is only half of the process. Most individuals consider a blocked strike to be a success, however, due to the force of many strikes a block can be very painful. When this occurs the blocker looses concentration and is unable to effectively respond to his attacker. Where proper desensitizing and strengthening have been included in the training blocking a strike does not distract the blocker but instead simply becomes a part of the total response to the attack.

Where strengthening and desensitizing of these primary block areas has been continually pursued the results are most impressive. Not only can the block be performed successfully but the block itself becomes a strike as the force of the block from a well conditioned and desensitized part of the body, such as a forearm, makes the striker feel that he is the one being struck. Also due to the desensitizing, the blocker does not have the inner inhibition against making a strong block and therefore increases his effectiveness. Conversely, the attacker surprised by the effectiveness of the block not only looses concentration but also looses his confidence. Following strikes are therefore delivered with less commitment out of respect, or fear of the effectiveness of the blocker.

This conditioning was previously accomplished by simply striking a hard surface such as a piece of wood or the like. A refinement was made many years ago by the Okinawan Karate masters who would take a round striking pole 6 inches in diameter and implant it in the ground so that approximately 5 feet of the pole extended out of the ground. The pole, being circular, was then quartered. Students would then strike the pole at which time the quartered pieces would come together producing a clacking sound. From the sound it could be determined generally what amount of force was applied during the strike. Difficulties with this procedure were many. First, each impact required a strike and the obvious expenditure of a significant amount of energy.

Therefore, desensitizing over a long duration was difficult. Also, due to the rounding of the quarters, the area of impact was not variable and therefore it was common that too much force was applied to too small an area resulting in pain or injury. Lastly, all the quartered pole were equally rigid and therefore no variation could be obtained for the beginner to separate him from the more experienced participant.

It should be noted, that prior art relative to the subject invention may include messaging devices which are totally inappropriate for the intended use. Many of these devices anticipate a rolling type motion and therefore use circular rods. Also, even where an impact is desired the same type of conditioning is not sought. Since there is no anticipated increase in desensitizing and conditioning the impact surfaces of the massage devices are generally not of varying widths nor are the rods of varying resistance.

It was in an attempt to incorporate the benefits found by the Okinawan Karate masters in their conditioning poles while improving on this concept that the subject invention was developed.

SUMMARY OF THE INVENTION

In response to these needs the subject invention was developed utilizing a solid piece of unitary hardwood, and I preferably use white oak. Bifurcating slits divide one end of the device into four rods having external flat surfaces. The wood is selected and the cut is made so that these external flat surfaces provide varying widths so that the force of the impact can be varied. Also, by varying the length of the slits between the rods variations can be obtained in rigidity. This allows the novice to utilize the widest side of the device, striking the area to be desensitized toward the end of the device where the rods are furthest from their point of attachment, and further selecting the side having the lowest possible slit so that the rods are less rigid. As conditioning and desensitizing takes place the user will begin striking the portion of his body to be desensitized with greater force. Since the device is hand held this may be accomplished easily, initially with a mere movement of the wrist. However, after an appropriate amount of force has been applied the user will then begin utilizing other portions of the device. Moving through a series of locations as one improves eventually to a narrower side, a set of rods bifurcated by the slit of least length and moving the point of impact toward the handle of the device. Since the corners are rounded, it is also possible after much conditioning to utilize the external corners of the rods to provide greater force upon impact.

The clacking sound which is produced when adjacent rods come together provide an audio indication relative to whether enough force is being used. In this way the user can move through a series of conditioning steps assuring that no injury takes place and eventually obtain the desired physical results.

DETAILED DESCRIPTION OF THE DRAWINGS

FIGS. 1A–1D disclose the conditioning hammer generally designated as 10. In my preferred embodiment the hammer is made from a hardwood, preferably white oak, sanded smooth and coated with varnish or other similar coating in order to provide the smoothest possible surface during impact. The hammer 10 is an elongate body of unitary construction having a handle 12 and impact portion 14.

Slits 16 bifurcate the various sides into individual rods 18. As shown in FIGS. 1A–1D the slits are of varying lengths and widths. Where the slits are shorter the rods 18 which are separated by the shorter slit Will be more rigid. Conversely, where the slit is longer the rods separated by the longer slit will be less rigid and provide more give during impact.

Figure 2:
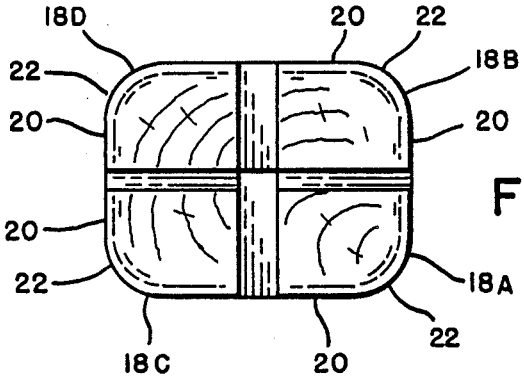
FIG. 2 is a top plan view of the invention.

When sufficient impact is applied to the part of the body to be toned with the rods a clacking sound will be made as adjacent rods come together. After a minimal amount of use the loudness of the clacking sound will serve as an audio indicator as to whether sufficient force is being applied. While it might seem that the feeling upon impact is a greater indicator it must be remembered that continued impacts lead to a desensitizing and therefore adjusting the degree of impact based upon the feel of the impact can lead to error. By varying the widths of the slit 16 one can use an impact surface which will provide the requisite audio indication with either a lesser or greater impact. As shown in FIG. 2 the hammer is rectangular in shape. Thus, the rods 18 have flat outer surfaces 20 and rounded edges 22. Also due to the rectangular nature of the device, opposing sides have the same length however, adjacent sides are of different lengths. In my preferred embodiment the narrower slits 24 bifurcate the shorter side so that the novice can utilize the broader side and easily obtain the clacking sound thereby obtaining the desired results with a minimum of impact.

By quartering the impact portion 14 as shown in FIG. 2 each rod has adjacent broader and narrower outer surfaces for impact. After a significant amount of toning and conditioning has taken place the rounded edges 22 which exist between the longer and shorter surfaces of each rod 18 can be used as an additional impact surface.

Figure 1A:
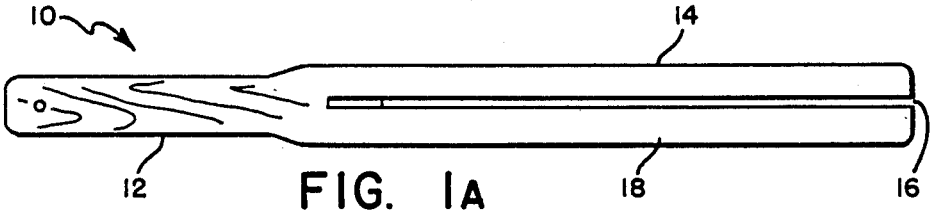
FIGS. 1A, 1B, 1C, 1D are side elevational views together showing each side of the invention.
Figure 1B:
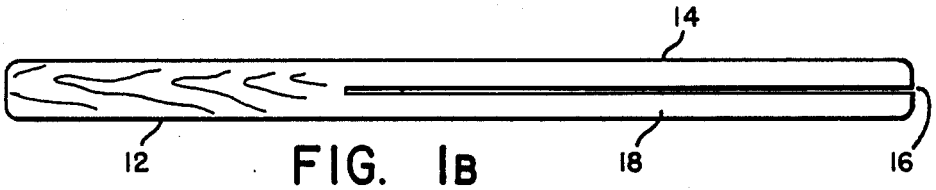
Figure 1C:
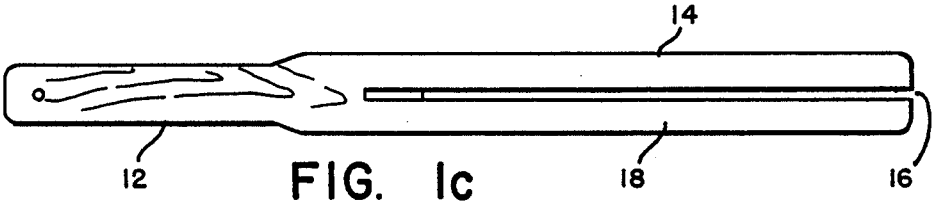
Figure 1D:
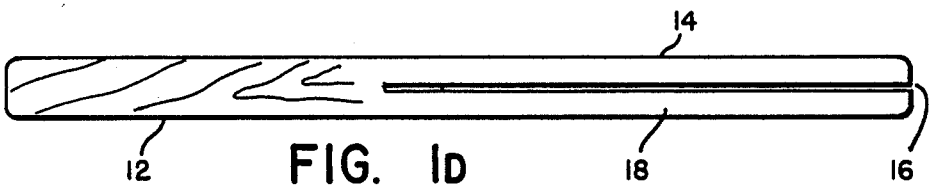
Figure 3:
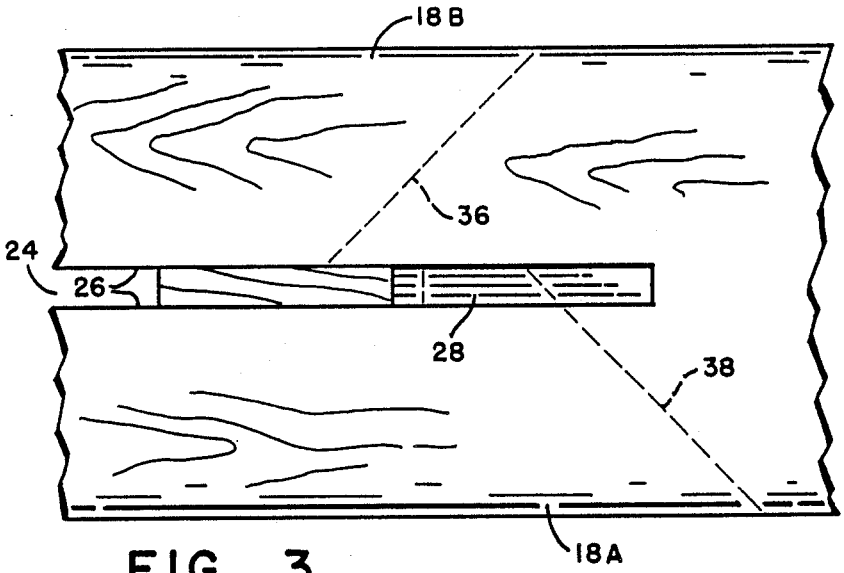
FIG. 3 is an enlarged view of the bottom portion of the slit in one side of the invention.
Figure 4:
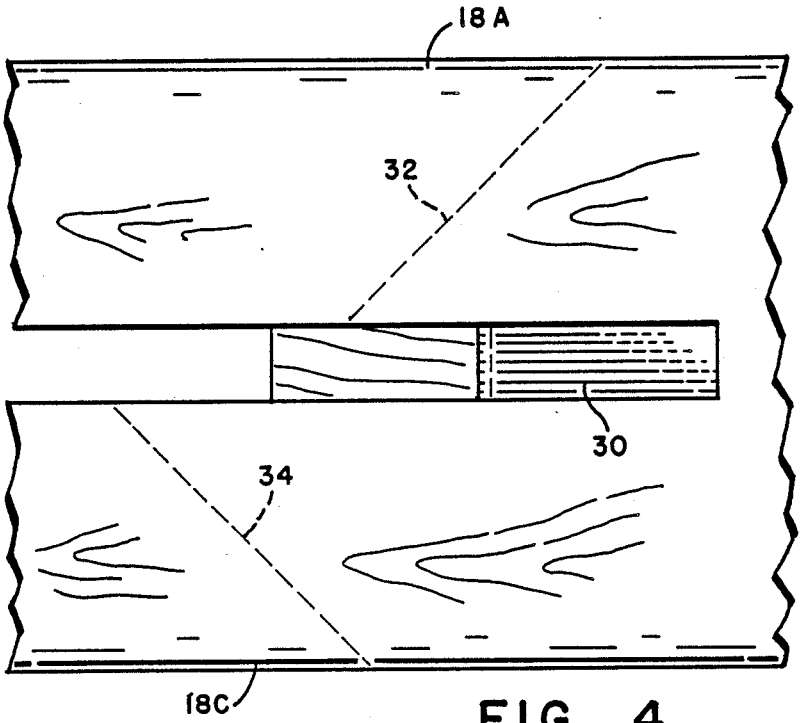
FIG. 4 is an enlarged view of the slit taken from the side of the invention adjacent to the side shown in FIG. 3.

FIGS. 3 and 4 are enlarged views of FIGS. 1A and 1B respectively. Looking first at one of the narrower slits 24 as shown in FIG. 3 it should be noted that the slits are between inner surfaces 26 of adjacent rods 18. The base of the slits are preferably angled as shown at slit base 28 between rod 18A and 18B. In FIG. 4 there is a second incline slit base 30 between rods 18C and 18A. In FIG. 4 the top dotted line 32 discloses the angle of inclination of the slit base 28. Similarly, the bottom dotted line 34 shows the angle of inclination for the base of the slit between rods 18C and 18D. In FIG. 3 the line 36, shown in phantom through rod 18D, disclosing the angle of inclination between rods 18B and 18D with the bottom line 38, shown in phantom through rod 18A, indicating the angle of inclination of the base of the slit between rods 18A and 18C.

In operation the neophyte begins by using the broader surface of the impact portion 14, using for example the side formed by rods 18B and 18D. As the area being worked on becomes more conditioned and desensitized over an extended period of time the user can move to a narrower side such as that formed between rods 18A and 18B. Continued usage can result in moving further down toward handle 12 thereby giving greater impact to each strike and significantly greater impact is needed in order to bring the rods together and produce the above described clacking sound. Continued usage can lead to sufficient conditioning and desensitizing that the user can use the rounded corners of the rods for applying impact.

While the above describes the preferred embodiment of the invention it should be appreciated that many variations may be made without departing from the actual invention. For example, though not inclusive, the length of the slits may be varied as well as the rod lengths, and the widths of the slits. Furthermore, various angles of inclination and declination can be used for the base of the slits in order to obtain the desired results. For these and other reasons it is intended that the scope of the invention be limited only by the appended claims.

I claim:

1. A hand held conditioning hammer comprising:

a substantially rigid elongate body having a handle portions and an impact portion, said impact portion having at least two longitudinal bifurcating slits dividing said impact portion into a plurality of spaced, substantially rigid rods, said slits being between inner surfaces of adjacent rods, which inner surfaces are opposite outer impact surfaces of the same rod, said at least two slits being of different length whereby a rod bracketed by said different length slits will thereby have different flexibility characteristics in two perpendicular directions and be capable of movement in each of said directions and wherein at least one of said rods has another rod located adjacent to it on two substantially perpendicular sides.

2. The invention of claim 1 wherein adjacent rods are equidistant from each other throughout their entire length.

3. The invention of claim 1 wherein said at least two slits are of different widths.

4. A hand held conditioning hammer comprising:

an elongate body having a handle portion and an impact portion;

said handle portion having a longitudinal axis, said impact portion being made from a substantially rigid material and having at least two slots extending substantially parallel to said longitudinal axis of said handle portion, said slots being located on adjacent side portions of said impact portion whereby said slots divide said impact portion into a plurality of substantially rigid rods whereby said rods are located so that each rod can be moved in at least two substantially perpendicular directions and in each of said two directions, it can contact an adjacent rod and wherein the adjacent side portions of the impact portion comprise at least two rods and wherein said side portions have different widths whereby impacting the device with the same momentum on a part of the body using first one of said side portions and then the other will produce two different effects on the impacted part of the body.

5. The hammer of claim 4 whereby said slots are sized to that each of said rods can be moved a predetermined distance towards an adjacent rod without contacting said adjacent rod.

6. The hammer of claim 4 wherein said impact portion is made from wood.

7. The hammer of claim 4 wherein said material of said impact portion has the quality whereby when the device is impacted on a human user, two rods can hit each other and provide an audible indication of said impact to said user.

8. The hammer of claim 4 comprising four of said slots located in said impact portion, said slots dividing said impact portion into 4 rods with said rods spaced from each other by said slots.

9. The hammer of claim 8 wherein at least two of said slots are of different lengths thereby providing the effect that at least one of said rods can be moved with less force than is required to move at least one other of said rods.

10. The hammer of claim 8 wherein all four rods have the same cross-section.

* * * * *